US009970664B2

(12) United States Patent
Brouard et al.

(10) Patent No.: US 9,970,664 B2
(45) Date of Patent: May 15, 2018

(54) SUPPORT FOR A COOKING VESSEL

(71) Applicant: APPLICATION DES GAZ, Saint Genis Laval (FR)

(72) Inventors: Christophe Brouard, Craponne (FR); Marc Champion, Lyons (FR); Maarten Kalis, Vaugneray (FR)

(73) Assignee: APPLICATION DES GAZ, Saint Genis Laval (FR)

( * ) Notice: Subject to any disclaimer, the term of this patent is extended or adjusted under 35 U.S.C. 154(b) by 387 days.

(21) Appl. No.: 14/650,432

(22) PCT Filed: Dec. 5, 2013

(86) PCT No.: PCT/FR2013/052951
§ 371 (c)(1),
(2) Date: Jun. 8, 2015

(87) PCT Pub. No.: WO2014/091119
PCT Pub. Date: Jun. 19, 2014

(65) Prior Publication Data

US 2015/0316271 A1 Nov. 5, 2015

(30) Foreign Application Priority Data

Dec. 10, 2012 (FR) ..... 12 61815

(51) Int. Cl.
*F24C 15/10* (2006.01)

(52) U.S. Cl.
CPC ..... *F24C 15/107* (2013.01)

(58) Field of Classification Search
CPC ..... F24C 15/107; A47J 36/34
See application file for complete search history.

(56) References Cited

U.S. PATENT DOCUMENTS

| | | | |
|---|---|---|---|
| 3,871,356 A | 3/1975 | Saponara | |
| 4,089,321 A | 5/1978 | Ondrasik, II | |
| 5,372,121 A | 12/1994 | Castillo et al. | |

FOREIGN PATENT DOCUMENTS

| | | | |
|---|---|---|---|
| CH | 161272 A | 4/1933 | |
| CN | 201636940 U | 11/2010 | |
| CN | 202141094 U | 2/2012 | |
| EP | 2535646 A1 * | 12/2012 | ..... F24C 15/107 |
| JP | S59170106 U | 11/1984 | |

OTHER PUBLICATIONS

International Search Report dated Apr. 7, 2014 re: Application No. PCT/Fr2013/052951; citing: U.S. Pat. No. 5,372,121 A, U.S. Pat. No. 3,871,356 A, JP S59 170106 U, CN 201 636 940 U, CN 202 141 094 U, EP 2 535 646 A1, U.S. Pat. No. 4,089,321 A and CH 161 272 A.

* cited by examiner

*Primary Examiner* — David J Laux
(74) *Attorney, Agent, or Firm* — Cantor Colburn LLP

(57) ABSTRACT

The invention relates to a support (5) for a cooking vessel, comprising a plurality of wings (25). The wings (25) are arranged in such a way as to at least partially define a free site (27) to be positioned over a burner (3) of a hot tray (1). Two consecutive wings (25) from the plurality of wings (25) define an opening (37) between each other. The support (5) for a cooking vessel is characterized in that an outer surface of each wing (25) has a concave form, and in that the concavity of the outer surface (29) of each wing (25) is oriented away from the free site (27).

10 Claims, 2 Drawing Sheets

SUPPORT FOR A COOKING VESSEL

TECHNICAL FIELD

The present invention relates to a support for a cooking vessel and a stove comprising the support.

BACKGROUND

The support is intended to maintain the cooking vessel at some distance from a burner of the stove. The burner must be close enough to the vessel to limit heat losses.

An evacuation of the flue gases generated by the combustion at the outlet of the burner is necessary. Thus the support is provided with openings so that the flow of flue gases is evacuated from the area located between the head of the burner and the vessel or the free area.

This system is satisfactory in that the flue gases do not stagnate in the free area and are evacuated towards the outside. The evacuation is even more effective that the openings are large and allow a good circulation of the flow of flue gases.

However, the flame is sensitive to the air flow penetrating into the free area by the openings. The flame can be extinguished by blowing, in particular by the wind during an outdoor stove use.

Large sized openings are advantageous to evacuate the flue gases, but offer little resistance to wind.

BRIEF SUMMARY

The present invention aims to solve all or part of the disadvantages mentioned above.

To this end, the present invention relates to a support for a cooking vessel including:

a plurality of fins, the fins being disposed so as to define at least partially a free location intended to be positioned facing a stove burner, two consecutive fins among the plurality of fins defining an opening therebetween, the support for a cooking vessel being characterized in that:

an outer surface of each fin has a concave shape, the concavity of the outer surface of each fin is oriented in the direction opposite to the free location.

Preferably, the fins are disposed outside the free location.

Particularly, the fins are laterally disposed with respect to the free location, considering a plane transverse to the direction of extension of the flames.

According to another aspect of the invention, the openings of the head of the burner are headed towards the free location.

The fins aim to protect the flame of the burner from the risks of blowing by the wind by creating a protective barrier. The concave shape brings an additional effect: a wind flow heading towards the burner and meeting the outer face of a fin is deflected into two lateral flows on either side of the concavity.

The diverted wind flow also creates a suction phenomenon aiming to evacuate flue gases from the free location by the openings.

According to one aspect of the invention, each fin has an inner surface, the inner surface being of a convex shape and the convexity of the inner surface being oriented in the direction of the free location.

The convex surface of the fin aims to improve the evacuation of the flue gases by the openings outside the free location. Indeed, a flow of flue gases coming from the free location and meeting a fin is guided by the convex shape towards the openings. The flowing of the gas flow is not stopped by the fin but rather deflected towards the opening.

According to one aspect of the invention, the fins are disposed along a closed contour around the free location.

According to one aspect of the invention, the fins are identical.

According to one aspect of the invention, the distance separating two consecutive fins is identical.

According to one aspect of the invention, the support for a cooking vessel comprises a ring intended to receive a cooking vessel.

According to one aspect of the invention, the ring is secured to an upper end of each fin. The upper end of the fin corresponds to the defined end according to the direction of extension of the flame of the burner.

According to one aspect of the invention, the ring has an upper surface of support, opposite to the fins.

According to one aspect of the invention, the upper surface comprises at least one step towards the inside of the ring.

According to one aspect of the invention, the upper surface comprises at least one step towards the outside of the ring.

According to one aspect of the invention, the support for a cooking vessel comprises a base including means for fastening a stove. The base is secured to a lower end of each fin and the lower end is opposite to the upper end of the fin.

According to one aspect of the invention, a stove comprises a support such as previously described, the stove comprising means for receiving the support. The support receiving means are arranged so that the support surrounds the free location and that a vessel deposited on the support is facing the flame of the burner.

BRIEF DESCRIPTION OF THE DRAWINGS

In any case the invention will be well understood using the description which follows with reference to the accompanying schematic drawings representing, by way of non-limiting example, an execution form of this support for a cooking vessel.

DETAILED DESCRIPTION

Figure 1:
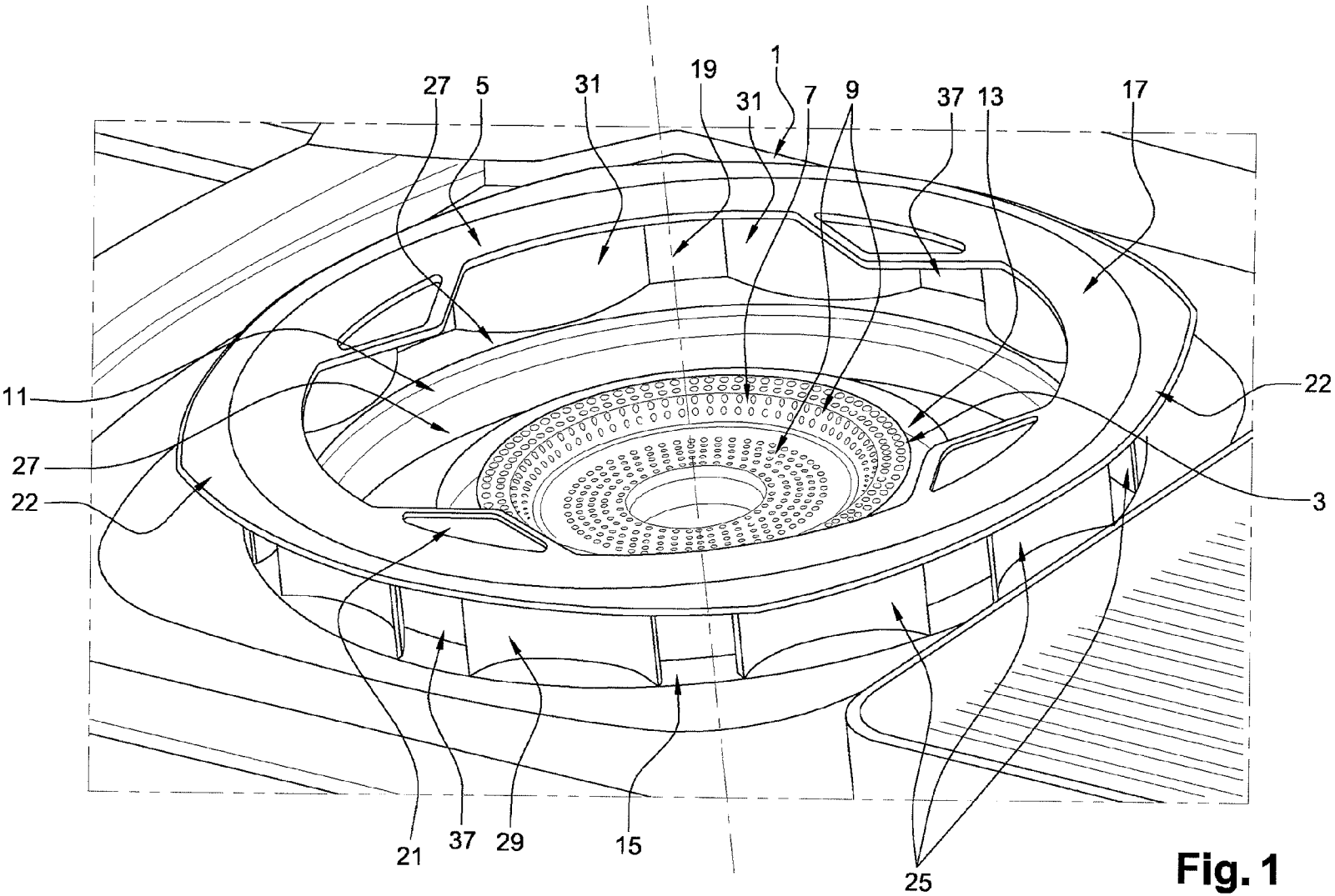
FIG. 1 is a perspective view of a stove comprising a support for a cooking vessel.
Figure 2:
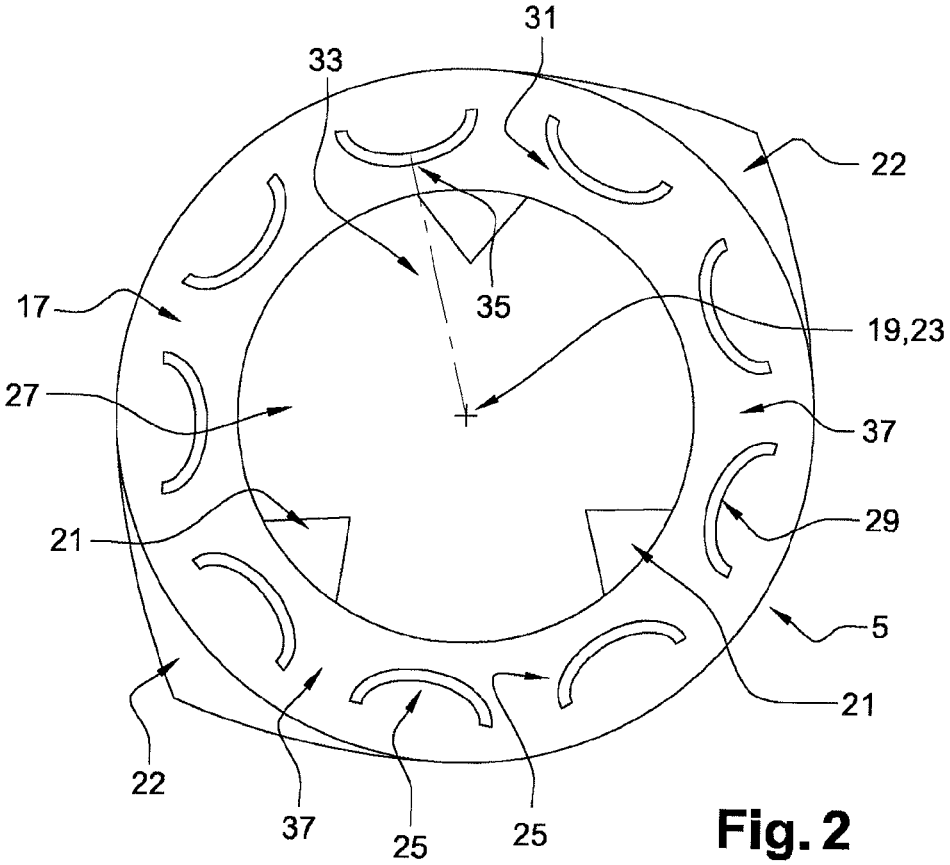
FIG. 2 is a schematic top view of the support for a cooking vessel.

As illustrated in FIG. 1, a burner 1 comprises a burner 3 and a support 5 for a cooking vessel. The burner 3 has a head 7 provided with a plurality of openings 9. A cup 11 having a central opening 13, surrounds the head 7 of the burner 3.

The support 5 comprises a base 15 provided with means for fastening the stove 1. According to one embodiment, the base 15 is secured to the cup 11 or rests on the cup 11 and delimits the lower part of the support 5, as illustrated in FIG. 1.

The support 5 comprises a ring 17 delimiting the upper part of the support 5. According to one embodiment illustrated in FIG. 1, the ring 17 is located opposite to the base 15 according to a reference axis 19. The ring 17 is intended to receive the cooking vessel. The ring 17 has steps 21 headed towards the center 23 of the ring 17 intended to stabilize the vessel placed on the support 5. Similarly, the ring 17 has steps 22 headed towards the outside and intended to stabilize the vessel placed on the support 5.

The support 5 comprises a plurality of fins 25 disposed in circle around the reference axis 19. The upper end of each fin 25 is secured to the ring 17 and the lower end of each fin 25 is secured to the base 15. The support 5 has a free location 27 defined as the space delimited by the plurality of fins 25 inside the support 5.

The free location 27 is defined as being facing the head 7 of the burner 3. The free location 27 is the area in which the gases exiting from the head 7 of the burner circulate according to the reference axis 19. Thus, as illustrated in FIG. 1, the fins 25 surround at least partially the free location 27 and are thus not comprised in the free location 27.

According to the reference axis 19, the free location 27 is delimited in its bottom part by the head 7 of the burner 3 and in its top part by the ring 17; the head 7 of the burner 3 and the ring 17 being excluded from the free location 27. Thus, part of the ring 17, comprising for example the steps 21, can be located facing the burner 3 and the free location 27.

Each fin 25 has an outer concave shaped surface 29 and an inner convex shaped surface 31. The inner surface 31 and the outer surface 29 of a fin 25 are parallel.

According to one embodiment, each fin 25 is symmetrical with respect to a plane 33 defined by the reference axis 19 and passing through the point 35 of the fin 25 nearest to the reference axis 19.

Two consecutive fins 25 are separated by an opening 37 putting into fluid communication the free location 27 with the outside.

In operation, the flames are generated by the inflammation of a gas/air mixture at the outlet of the head 7 of the burner 3 at the openings 9 and extending into the free location 27.

The combustion generates flue gases, evacuated at least partially from the free location 27 towards the outside by the openings 37 located between the fins 25.

Figure 3:
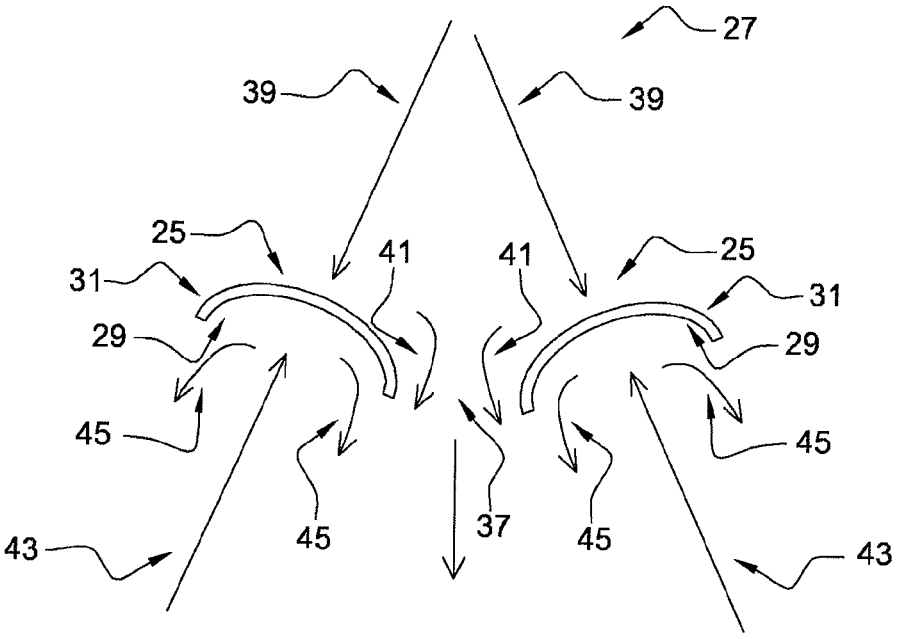
FIG. 3 is a schematic top view of two fins.

Typically, the flue gases circulate from the central part towards the periphery of the free location 27, as illustrated in FIG. 3. A flow of flue gases 39, heading opposite to a fin 25, is separated into two lateral flows of flue gases 41 by the convexity of the inner surface 31.

The lateral flows of flue gases 41 are guided by the inner surface 31 towards the openings 37 located between the fins 25. Thus, the flue gases are headed towards the openings 37 by the plurality of fins 25.

The outer concave shaped surface 29 of the fins 25 has a protective role in relation to wind coming from the outside. As illustrated in FIG. 3, an incident wind flow 43 arriving opposite to a fin 25 is separated into two lateral wind flows 45 by the concavity of the outer surface 29.

The lateral wind flows 45 are guided by the outer surface 29 and are oriented towards the outside of the support 5 at the ends of the fins 25 contiguous to the openings 37.

The lateral wind flows 45, headed towards the outside of the support 5 at the openings 37, create a suction phenomenon favorable for the evacuation of the flue gases coming from the free location 27.

Thus the shape of the fins 25 promotes at the same time a good evacuation of the flue gases and protects the flames from risks of blowing due to the penetration of wind into the free location 27.

It goes without saying that the invention is not limited to the sole form of execution of this device, described above by way of example, on the contrary, it encompasses all the variants.

The invention claimed is:

1. A stove comprising:

a burner having a plurality of openings arranged to provide gas for flames of the burner, the burner comprising an outer perimeter within which the plurality of openings are located; and support for a cooking vessel including:

a plurality of fins disposed outside the outer perimeter of the burner so as to define at least partially a free location intended to be positioned facing the burner, two consecutive fins among the plurality of fins defining therebetween an opening, wherein an outer surface of each fin has a concave shape, wherein the concavity of the outer surface of each fin is oriented in a direction opposite to the free location, such that the fins create a barrier protecting the flames of the burner from air being blown towards the burner.

2. The stove according to claim 1, wherein each fin has an inner surface, the inner surface being of a convex shape and the convexity of the inner surface being oriented in a direction of the free location.

3. The stove according to claim 1, wherein the fins are disposed along a closed contour around the free location.

4. The stove according to claim 1, further comprising a ring intended to receive a cooking vessel.

5. The stove according to claim 4, wherein the ring is secured to an upper end of each fin, the upper end of the fin corresponding to a defined end according to a direction of extension of a flame of the burner.

6. The stove according to claim 5, wherein the ring has an upper support surface, opposite to the fins.

7. The stove according to claim 6, wherein the upper surface comprises at least one step towards an inside of the ring.

8. The stove according to claim 6, wherein the upper surface comprises at least one step towards an outside of the ring.

9. The stove according to claim 1, comprising a base secured to a lower end of each fin, wherein the lower end is opposite to the upper end of the fin.

10. The stove according to claim 1, the stove being arranged so that the support surrounds the free location and that a vessel deposited on the support is facing a flame of the burner.

* * * * *